United States Patent [19]

Nakase et al.

[11] Patent Number: 4,765,075

[45] Date of Patent: Aug. 23, 1988

[54] WATER PROPULSION UNIT OF WATER JET PROPULSION CRAFT

[75] Inventors: Ryoichi Nakase; Masayoshi Nanami, both of Hamamatsu, Japan

[73] Assignee: Sanshin Kogyo Kabushiki Kaisha, Hamamatsu, Japan

[21] Appl. No.: 894,281

[22] Filed: Aug. 7, 1986

[30] Foreign Application Priority Data

Aug. 8, 1985 [JP] Japan ..... 60-174866

[51] Int. Cl.[4] ..... B63H 11/02

[52] U.S. Cl. ..... 440/38; 114/270; 440/111; 440/112

[58] Field of Search ..... 114/270; 440/38, 40, 440/1, 47, 112, 111

[56] References Cited

U.S. PATENT DOCUMENTS

| | | | |
|---|---|---|---|
| 3,324,822 | 6/1967 | Carter, III | 440/87 |
| 3,827,392 | 8/1974 | Jones | 440/38 |
| 3,859,951 | 1/1975 | Woodfill | 440/112 |

FOREIGN PATENT DOCUMENTS

| | | | |
|---|---|---|---|
| 2061851 | 5/1981 | United Kingdom | 440/112 |

*Primary Examiner*—Sherman D. Basinger
*Assistant Examiner*—Edwin L. Swinehart
*Attorney, Agent, or Firm*—Ernest A. Beutler

[57] ABSTRACT

Several embodiments of water propulsion units for water jet propulsion crafts wherein an improved bearing support is provided for supporting an elongated drive shaft to permit the engine to be positioned well forwardly in the hull. In accordance with each embodiment, the bearing support member is elongated and is affixed rigidly to the jet propulsion unit in a radial direction for facilitating alignment.

7 Claims, 4 Drawing Sheets

Fig-2
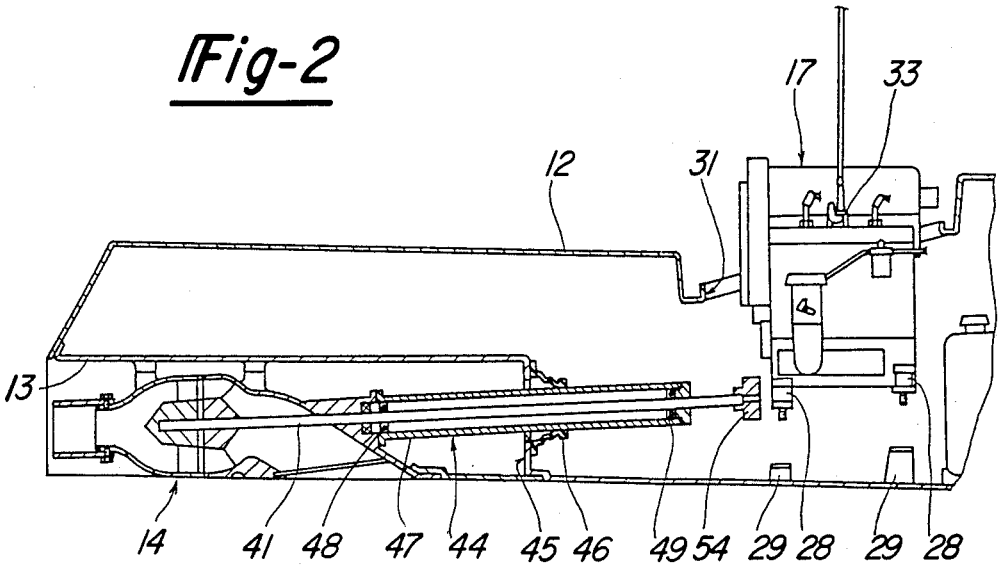
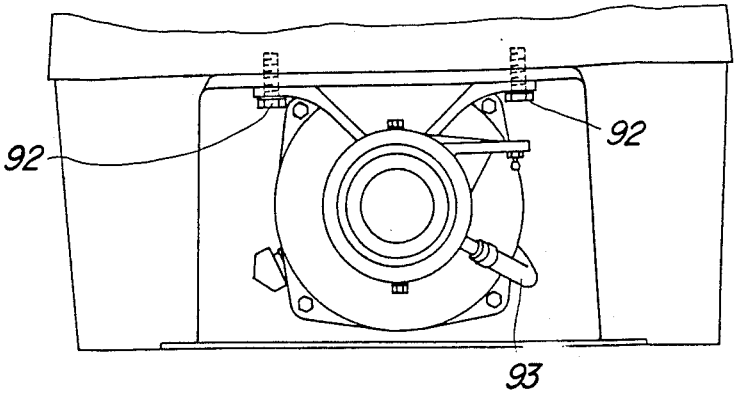
Fig-4

WATER PROPULSION UNIT OF WATER JET PROPULSION CRAFT

BACKGROUND OF THE INVENTION

This invention relates to a water propulsion unit for a water jet propulsion craft and more particularly to an improved arrangement for driving the water propulsion unit and for assembling the watercraft.

The use of water jets for propulsion units in a wide variety of watercraft is well known. One of the more popular types of such watercraft is a small, single rider unit that is designed to be operated by a rider wearing a swimming suit. With this type of unit, the engine should be mounted at a generally forward location so as to improve the balance of the unit and provides sufficient room for the rider. However, it is also desirable for the water jet to be placed at the rear of the watercraft and this means that its impeller is spaced a substantial distance from the driving engine. As a result, the drive shaft is very long and it is normally the practice to support the drive shaft by axially spaced bearings. This means that there are difficulties in radially aligning the bearings, drive shaft, engine output shaft and impeller. Unless properly aligned, the drive unit can cause undesirable vibrations. Furthermore, the arrangements for supporting the drive shaft which have been successful in avoid vibrations have made servicing of the individual components, such as removal of the water jet, difficult.

It is, therefore, a principal object of this invention to provide an improved arrangement for this type of watercraft.

It is a further object of this invention to provide an improved arrangement for supporting the drive shaft of a water jet type of watercraft wherein servicing is facilitated and alignment of the drive shaft, impeller and engine is simplified.

It is another object of this invention to provide an improved method for assembling a water jet type of watercraft.

SUMMARY OF THE INVENTION

A first feature of this invention is adapted to be embodied in a jet powered type of watercraft comprising a hull and an engine compartment provided at the forward end thereof. A tunnel is formed at the rearward end of the hull and a rider's area is positioned in overlying relation to the tunnel and is adapted to accommodate a rider in a straddle-type posture. A jet propulsion unit is carried by the hull and is positioned at least in part in the tunnel and means including a drive shaft driven by the engine drive the jet propulsion unit. In accordance with this feature of the invention, a bearing support is fixed radially relative to the jet propulsion unit and extends forwardly therefrom and into the hull and rotatably journals the drive shaft contiguous to its driving connection to the engine.

Another feature of this invention is adapted to be embodied in a method for assembling a jet type watercraft of the type previously noted. In accordance with this invention, the engine is mounted in the watercraft independently of the jet drive unit with the drive shaft being supported by the jet drive unit upon assembly into the hull of the watercraft. An aligned spacer is interposed between the forward end of the drive shaft and the rearward end of the engine output shaft for alignment purposes. The alignment spacer is then removed and a coupling is inserted for coupling the drive shaft to the engine output shaft.

BRIEF DESCRIPTION OF THE DRAWINGS

FIG. 2 is a partial cross-sectional view of the watercraft shown in FIG. 1, showing how the engine is installed in the watercraft.

FIG. 4 is a rear elevational view taken in the direction of the arrow 4 in FIG. 3.

DETAILED DESCRIPTION OF THE PREFERRED EMBODIMENTS

Figure 1:
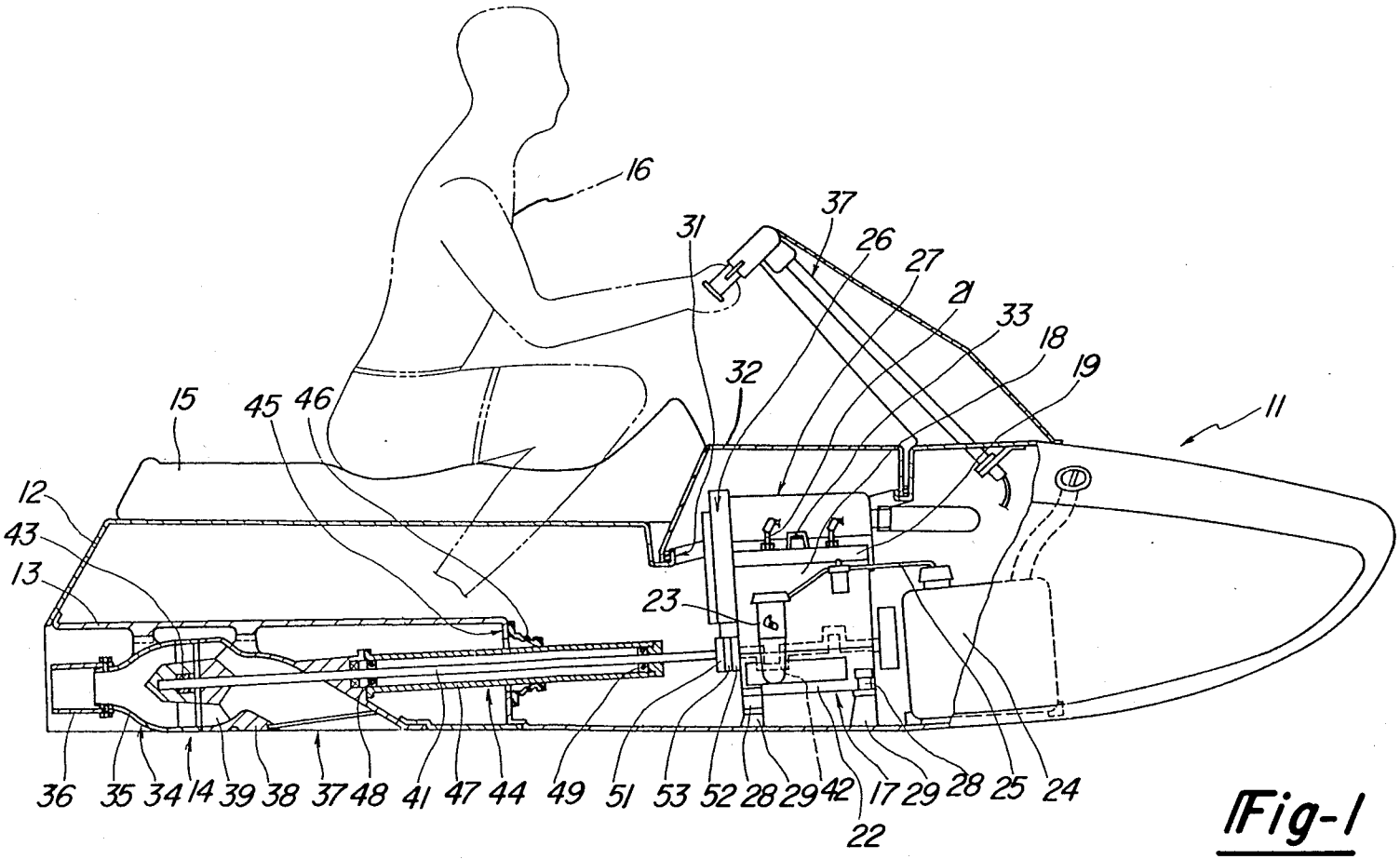
FIG. 1 is a side elevational view, with portions broken away and other portions shown in section, of a watercraft constructed in accordance with a first embodiment of the invention.

A watercraft constructed in accordance with a first embodiment of the invention is shown in FIGS. 1 and 2 and is identified generally by the reference numeral 11. The watercraft 11 includes a hull, indicated generally by the reference numeral 12 and which is formed at its rearward end with a tunnel 13. A jet propulsion unit, indicated generally by the reference numeral 14, is positioned within the tunnel 13 beneath the hull 12.

A rider's area such as a seat 15 is positioned on the hull 12 over the tunnel 13 and is adapted to accommodate a single rider, shown in phantom and identified by the reference numeral 16, seated in a straddle fashion.

Forwardly of the seat 15, and within an opening formed at the forward portion of the hull 12, there is provided an internal combustion engine, indicated generally by the reference numeral 17, for powering the watercraft 11. It should be noted that it is desirable to position the engine 17 at a forward location so as to insure good balance of the watercraft. In addition, the engine should be positioned in an area where it will not encroach on the rider's area. The engine 17 includes a cylinder block 18 that forms a plurality of cylinders to which a cylinder head 19 is affixed in the known manner. Spark plugs 21 are carried by the cylinder head 19 and fire the charge which is delivered to the engine chambers from a suitable charge former, such as a carburetor. In the illustrated embodiment, the engine 17 is of the two-cycle, crankcase compression type and, for this purpose, a crankcase 22 is provided beneath the cylinder block 18 and a carburetor and intake manifold 23 deliver the fuel/air charge to the crankcase.

A fuel tank 24 is positioned in the hull 12 forwardly of the engine 17 and supplies fuel to the carburetor 23 through a fuel line 25.

The engine 17 further has an exhaust system that includes an exhaust pipe and expansion chamber 26 that receives the exhaust gases from the exhaust manifold of the engine and which transfers them to a further expansion chamber 27 for expansion, cooling and eventual discharge to the atmosphere.

The engine 17 is supported within the hull 12 by means of elastomeric supports 28 that are carried by supporting blocks 29 formed in the hull 12.

The hull is formed with an opening 31 that surrounds the engine 17 and which is closed by a hatch or cover 32. A lifting lug 33 is provided on the engine 17 so that the engine may be conveniently installed and removed as shown in FIG. 2.

The jet drive unit 14 is comprised of an outer housing 34 having a discharge end 35 to which is mounted a pivotal steering nozzle 36. The nozzle 36 is steered by means of a tiller mechanism 37 in a known manner.

The housing 34 further provides an inlet opening 37 through which water is drawn from the body in which the watercraft is operated. The forward section 38 of the housing defines this inlet opening 37. An impeller 39 is supported within the housing for drawing water through the inlet 37 and discharging it through the nozzle 36 for driving the watercraft 11 in a known manner.

It should be noted that the impeller 39 is positioned a long way from the engine 17. A drive shaft 41 is provided for driving the impeller 39 from an output shaft 42 of the engine. The drive shaft 41, even though it is long, is well supported throughout its length and these supports are all rigidly affixed to the jet drive housing 34 so as to minimize the likelihood of vibrations and to facilitate alignment.

The first bearing which supports the drive shaft 41 is a rear bearing 43 that is carried internally of the jet drive housing 34. Adjacent the forward end of the jet drive housing 34, there is provided a supporting tube 44 that is bolted or otherwise suitably affixed to the jet drive housing 34. The tube 44 extends forwardly through a front wall 45 of the hull 12 and specifically the forwardmost wall of the tunnel 13. A sealing boot 46 encircles the supporting tube 44 internally of the hull. The supporting tube has a generally cylindrical portion 47 that receives an intermediate bearing 48 at its rear end for supporting the forward portion of the drive shaft 41 where it passes through the housing of the jet drive unit 34. The tube 47 extends forwardly and terminates adjacent the rear end of the engine and there supports a forwardmost bearing 49 which supports the forward end of the drive shaft. This bearing is spaced a substantial distance "L" from the front of the inlet opening 37. The forward end of the drive shaft 41 carries a coupling member 51 that is coupled to a coupling member 52 which is affixed to the rear end of the engine output shaft. An elastomeric member 53 is interposed between the couplings 51 and 52 for assisting in vibration damping.

Upon installation, the coupling members 51, 52 and elastomeric member 53 are omitted and a jig member 54 is affixed to the forward end of the drive shaft 41 (FIG. 2). This jig member 54 is used for aligning purposes so that the engine 17 may be properly shimmed to match up with the drive shaft before the couplings are inserted. In this way, alignment is facilitated and no damage to the coupling members will result.

In this embodiment, the entire jet drive unit, supporting tube 44 and drive shaft 41 may be removed as a unit through detachment of the jet drive housing 34 from the hull and withdrawal of the tubular supporting member 44 through the enlarged opening formed in the wall 45 of the hull through which this member passes.

Figure 3:
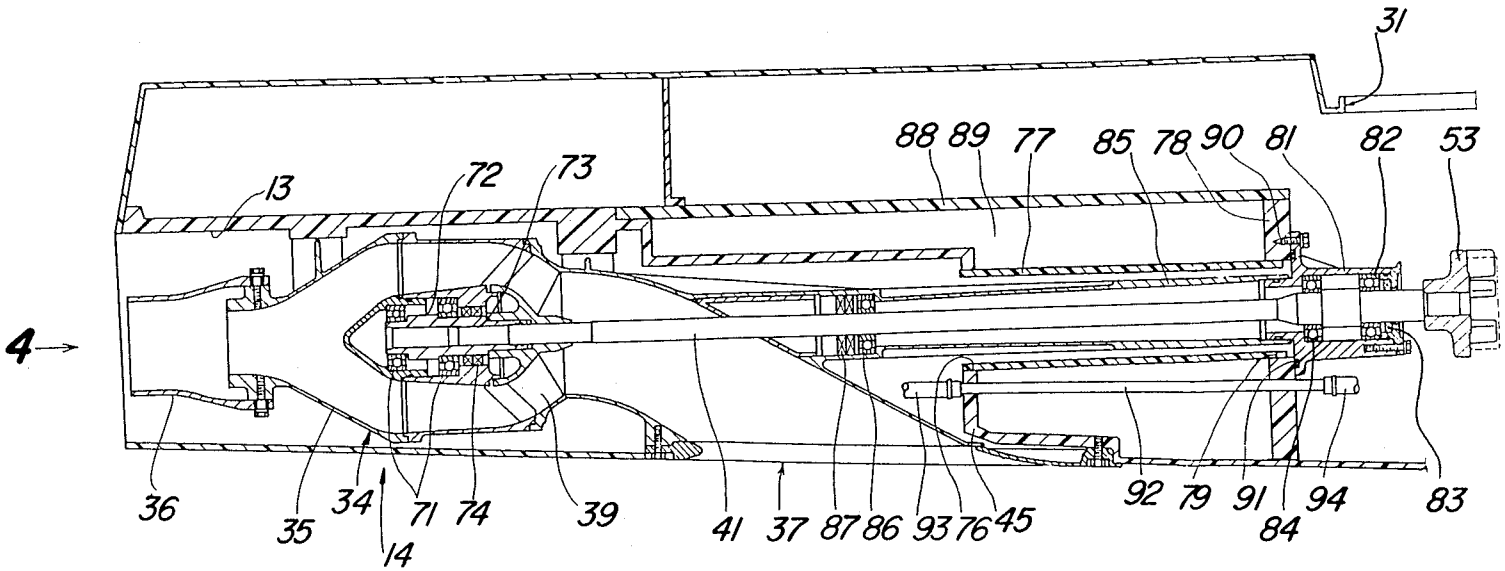
FIG. 3 is an enlarged cross-sectional view, in part similar to FIGS. 1 and 2, and shows a further embodiment of the invention.

FIGS. 3 and 4 show another embodiment of the invention wherein the construction is slightly different. The elements of this embodiment which are the same or substantially the same as the embodiments of FIGS. 1 and 2 are identified by the same reference numerals and will not be described again in detail. Basically, this embodiment differs from the previously described embodiment in the manner of support of the drive shaft 41.

The housing 34 of the jet drive unit 14 supports a pair of axially spaced bearings 71. The bearings 71 support a sleeve 72 which sleeve is affixed for rotation with the impeller 39, as by means of a threaded connection. In addition, the drive shaft 41, in this embodiment, is provided with a splined end 73 that mates with corresponding splines on the sleeve 72 for drivingly coupling the drive shaft 41 to the sleeve 72 and impeller 39. An annular seal or packing 74 encircles the sleeve 72 for protecting the bearing 71.

In this embodiment, the front wall 45 of the tunnel 13 defines an opening 76 which receives one end of a tubular member 77. Unlike the previous embodiment, however, the tubular member 77 does not itself support bearings for supporting the drive shaft 41.

The forward end of the sleeve 77 is supported within a bulkhead 78 and specifically within a bore 79 formed in the bulkhead 78. A bearing housing 81 is affixed to the bulkhead 78 and supports the drive shaft 41 adjacent the coupling 53 by means of an anti-friction bearing 82 which is spaced a substantial distance "L" from the inlet opening 37. A seal 83 is provided forwardly of the bearing 82. In addition, a further bearing 84 is supported at the rear end of the sleeve 81 adjacent the bulkhead 78 and also supports the forward end of the drive shaft 41.

The rear end of the sleeve 81 supports a tubular member 85 which, in turn, carries a bearing 86 at its rear end which supports the drive shaft 41 immediately adjacent the area where the drive shaft 41 passes through the housing 34 of the jet drive unit. A seal 87 is provided at the rear end of the bearing 86 within the sleeve 85 for protecting the beargins 86 and 84.

The bulkhead 78 is further supported by means of a cover plate 88 which is fixed appropriately to the hull and which defines a cavity 89 that surrounds the tubular member 77 for assisting in sealing and support.

Threaded fasteners 90 hold the tubular support 81 to the bulkhead 78 and an O-ring seal 91 prevents leakage in this area.

The jet drive unit 14 and specifically an outer housing 34 is held in the tunnel 13 by means of threaded fasteners 92 which may be conveniently removed so as to permit the jet drive unit 14 to be removed as a unit from the watercraft. It should be noted that when this is done, the tube 85 will also be removed, however, the drive shaft 41 will still be held in place and supported by the bearings 82 and 84 carried within the tubular member 81 that is affixed to the bulkhead 78. However, as with the previously described embodiment, alignment is insured.

A tube 92 extends through the cavity 89 and is fixedly supported therein in an appropriate manner. Water is delivered to the tube 92 from the jet drive discharge portion 35 through a flexible conduit 93. This liquid is then transferred forwardly through a flexible conduit 94 to the engine cooling system for cooling the engine.

The embodiment of FIGS. 3 and 4 may be assembled in a manner similar to the embodiment of FIGS. 1 and 2 using a temporary jig, such as the jig 54, for alignment purposes during the installation of the engine.

Figure 5:
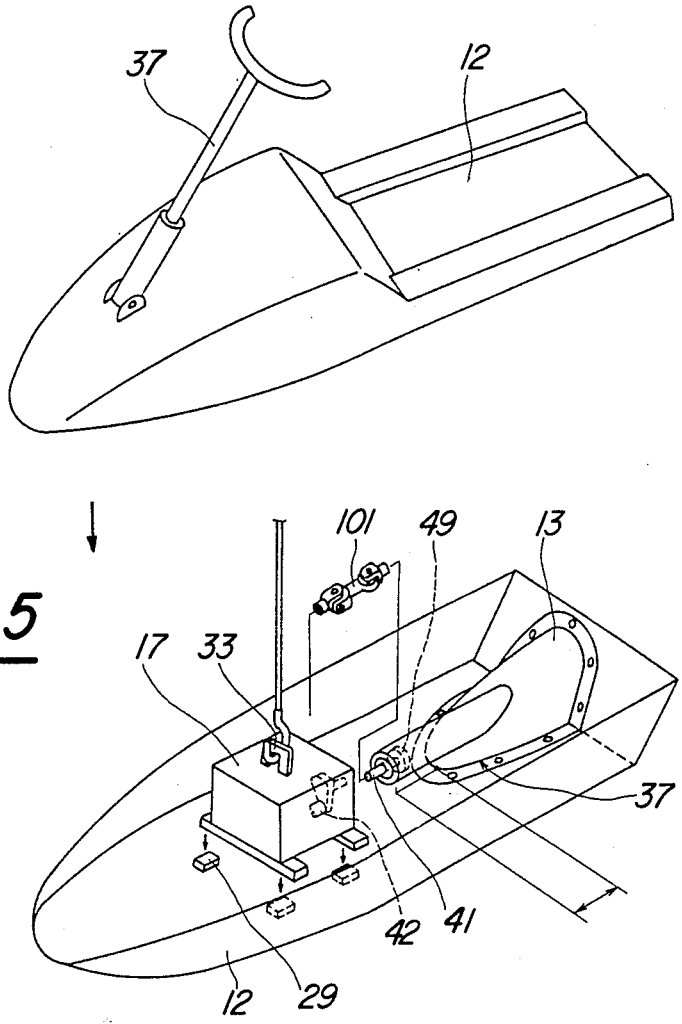
FIG. 5 is a partially exploded view showing how a watercraft is assembled in accordance with a yet further embodiment of the invention.
Figure 6:
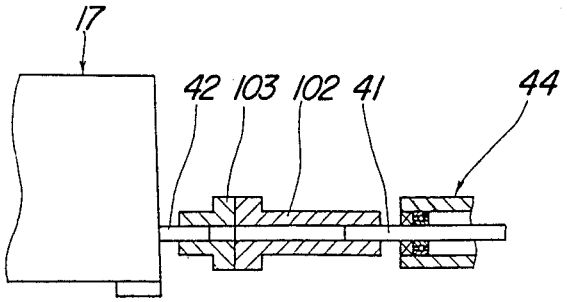
FIG. 6 is a partial cross-sectional view showing the alignment tool used to assemble the watercraft of the embodiment of FIG. 5.

FIGS. 5 and 6 show another assembly embodiment, which may be used with drive shaft supports of the type shown in either FIGS. 1 and 2 or FIGS. 3 and 4. In this embodiment, however, the drive shaft 41 is connected to the engine output shaft 42 in the final assembly by means of an intermediate shaft 101 and a pair of universal joints connected to its opposite ends.

In this embodiment, the lower portion of the hull 12 is completed through the installation of the jet drive unit 14 with the tube 44 for supporting the drive shaft 41. The engine 17 is then lowered through the use of its lifting lug 33 and a jig consisting of a first portion 102 is slipped over the forward end of the drive shaft 41 and a second portion 103, which is slipped over the rear end of the drive shaft 42. The portions 102 and 103 have interengaging faces as shown in FIG. 6 so that the engine 17 may be shimmed to the proper height so as insure correct alignment between the engine output shaft 42 and the drive shaft 41. The jigs 102 and 103 are then removed and the intermediate shaft 101 and universal joints are assembled to complete the engine drive shaft alignment.

It should be readily apparent that each of the described embodiments provides a very good and effective support for the elongated drive shaft which support is carried by the jet drive unit so as to minimize misalignment and to simplify both assembly and disassembly. Although several embodiments of the invention have been illustrated and described, various changes and modifications may be made without departing from the spirit and scope of the invention, as defined by the appended claims.

We claim:

1. In a jet powered type of watercraft comprising a hull having an engine compartment containing an engine provided at the forward end thereof, a tunnel at the rearward end thereof, and a rider's area overlying said tunnel and adapted to accommodate a rider, a jet propulsion unit comprising an outer housing defining a water inlet, an impeller cavity and a discharge nozzle, an impeller journaled by said outer housing, said outer housing being carried by said hull and positioned at least in part in said tunnel substantially rearwardly of said engine compartment and rearwardly of said rider's area, a bulkhead separating said engine compartment from said tunnel, and means including a drive shaft driven by said engine for driving said impeller of said jet propulsion unit, the improvement comprising a bearing support tube radially fixed directly to said jet propulsion unit outer housing and extending forwardly therefrom through said bulkhead and into said hull and terminating adjacent said engine and bearing means fixed within said tube within said hull forwardly of said bulkhead and rotatably journaling said drive shaft contiguous to its drive connection to said engine.

2. In a jet powered type of watercraft as set forth in claim 1 wherein the bearing support tube further supports a second bearing adjacent its connection to the outer housing for journaling said drive shaft contiguous to said jet propulsion unit.

3. In a jet powered type of watercraft as set forth in claim 1 wherein the jet propulsion unit is removable as a unit from the watercraft.

4. In a jet powered type of watercraft as set forth in claim 3 wherein the bearing support tube is removable as a unit with the jet propulsion unit.

5. In a jet powered type of watercraft as set forth in claim 1 and further including an elastic seal interposed between the bearing support tube and the bulkhead for preventing the ingress of water through said tunnel into the interior of said hull.

6. In a jet powered type of watercraft as set forth in claim 2 further including an elastic seal interposed between the bearing support tube and the bulkhead for preventing the ingress of water through said tunnel into the interior of said hull.

7. In a jet powered type of watercraft as set forth in claim 4 further including an elastic seal interposed between the bearing support tube and the bulkhead for preventing the ingress of water through said tunnel into the interior of said hull.

* * * * *